US009995089B1

(12) United States Patent
Carpenter

(10) Patent No.: US 9,995,089 B1
(45) Date of Patent: Jun. 12, 2018

(54) METHOD AND APPARATUS FOR EFFICIENT BI-ROTATIONAL DRILLING

(71) Applicant: William Thomas Carpenter, Houston, TX (US)

(72) Inventor: William Thomas Carpenter, Houston, TX (US)

( * ) Notice: Subject to any disclaimer, the term of this patent is extended or adjusted under 35 U.S.C. 154(b) by 0 days. days.

(21) Appl. No.: 15/453,571

(22) Filed: Mar. 8, 2017

(51) Int. Cl.
*E21B 17/04* (2006.01)
*E21B 17/043* (2006.01)
*E21B 17/046* (2006.01)
*F16L 15/08* (2006.01)

(52) U.S. Cl.
CPC ..... *E21B 17/043* (2013.01); *E21B 17/046* (2013.01); *F16L 15/08* (2013.01)

(58) Field of Classification Search
CPC ..... E21B 17/02; E21B 17/04; E21B 17/042; E21B 17/0426; E21B 17/16
USPC ..... 285/914
See application file for complete search history.

(56) References Cited

U.S. PATENT DOCUMENTS 2,273,017 A * 2/1942 Boynton ..... E21B 17/0423 285/288.5
3,623,753 A * 11/1971 Henry ..... E21B 17/043 285/330
5,950,744 A * 9/1999 Hughes ..... E21B 17/046 166/242.6
9,133,968 B2 * 9/2015 Elrick ..... E21B 17/046
2004/0011520 A1 * 1/2004 McGarian ..... E21B 4/02 166/117.7
2005/0116469 A1 * 6/2005 Parker ..... E21B 17/042 285/354
2011/0180273 A1 * 7/2011 Hughes ..... E21B 17/04 166/380

* cited by examiner

*Primary Examiner* — Kenneth L Thompson
(74) *Attorney, Agent, or Firm* — Douglas Baldwin

(57) ABSTRACT

A system for connecting drill pipe to facilitate bi-rotational drilling and methods of bi-rotational drilling using the system are described. The system includes a rotatable sleeve disposed on the end of one pipe joint and a guide on the other pipe joint in which both sleeve and guide have mating threads to pull the joint together and pipe end structures to prevent rotation when the joints are pulled together.

10 Claims, 4 Drawing Sheets

METHOD AND APPARATUS FOR EFFICIENT BI-ROTATIONAL DRILLING

BACKGROUND

Field of Invention

This invention is in the field of drilling, repair, or maintenance of geological wells.

Background

In the drilling, repair, or maintenance of geological wells, particularly oil and gas wells, sections (joints) of pipe must be connected and disconnected to be inserted or withdrawn from a well. The connected joints of pipe are typically called a drill string and is generally rotated to drill, complete maintain or repair the well bore. These generally threaded connections, are either integral to the pipe wall, or may be formed in pipe material that has been forged into the ends of pipe joints or by a connecting device that has been fused, welded, threaded, or otherwise joined to pipe ends. Added material is usually needed since the wall thickness of typical drill pipe is insufficient to provide a good threaded connection and seal.

These connecting devices, commonly referred to as "tool joints", are designed to take the wear and tear of being threaded or unthreaded together as the joints of pipe are inserted or withdrawn from a well being drilled, completed, maintained, or repaired. These tool joints require high torque values to form and maintain the required mechanical and fluid seal and prevent them from becoming unscrewed during ordinary use. The mechanical connection of these tool joints is accomplished with threads that are tightened to also provide a fluid seal formed between the integral shoulders of the connecting devices that are on the end of each section of pipe. These tool joints require high torque rotation to form and maintain the required mechanical and fluid seal and prevent them from becoming unscrewed during ordinary use. These high torque values require high horsepower inputs into heavy duty gripping, holding and rotating mechanisms that cause high mechanical wear and tear on such equipment and creates dangerous and hazardous working conditions for the personnel involved in these operations. These conventional mechanical connections allow the pipe to be rotated at the surface to provide a rotational torque to a drilling device (drill bit) attached to the lower end of the connected drill pipe string or provide a conduit for a downhole fluid operated rotational device. The joints of pipe, so joined, are used to provide a means to transmit rotational force, regulate the weight to be applied and the torque to be employed to operate various devices used to drill, complete, maintain or repair a well. During the drilling phase these series of so connected pipes, known as the "drill pipe", provide the means to transmit the desired forces to a drilling cutting tool, known as the "drill bit" or to other devices that cut, crush and/or abrade the various formations that comprise the earth's layers and act as a conduit to circulate a fluid, known as "drilling mud." Drilling mud is used to clean, lubricate and cool the drill bit or other devices and carry the resulting cuttings and debris back to the surface while providing a means for hydraulic pressure regulation over the geological formations being encountered to obtain a desired well. Failures of any of the components of these connections either from the mechanical connection that holds the pipes together or the mechanical seal that contains the pressurized abrasive drilling fluids may result in expensive attempted recovery operations and losses because of or due to non-productive drilling time.

Conventionally, these pipe joint connections employ right-hand threads (clockwise rotation) to mechanically seal and join them together. Therefore, to perform their required functions, they can only be rotated clockwise Conventionally, the drilling devices and other components known as the "bottom-hole assembly," by those familiar with the art of drilling wells, are designed to operate efficiently when rotated to the right. Therefore, it is necessary to rotate the joined pipes clockwise, to prevent unscrewing connection. Thus, Because, the conventional drill pipe can only be rotated in one direction, the drilling device or drill bit also was manufactured to rotate to the right as well When the penetration (cutting) rate of the drilling device is reduced after the bit becomes worn, dulled or damaged, or not appropriate for the formations being encountered, it becomes desirable or necessary to change, modify or replace the drilling device or some other component of the bottom-hole assembly. In order to effectuate such a change or modification, all of the drill pipe in the drilled hole must be unscrewed in sections and withdrawn to make the desired change or modification and then screwed back together and reinserted in the drilled hole again in order to continue the drilling process.

Deficiencies

Therefore, as explained in the foregoing, conventionally threaded drill pipe connecting devices all require the same, generally right-hand threads, allowing for only a clockwise rotation. Because of this design, complementing drill bits and devices are likewise manufactured to be utilized only when rotated to the right, resulting in numerous deficiencies in the drilling process. Without the ability to employ bi-rotational drill bits or devices, cutting, crushing, or boring surfaces continuously and in multiple directions is not only impossible, but also substantially decreases productivity, wastes fuel and energy, increases costs, and ultimately leads to the rapid deterioration of the drilling equipment. For example, frequent trips to drill a hole result in increased fuel and energy usage due to the multiple withdrawal and insertion of the drill string as well as the concentrated wear and tear on the gears of the surface equipment. In addition, expensive, heavy gripping devices that are necessary to obtain high torque values and make up and break out the tool joints required for the mechanical connection and mechanical fluid seal, often damage the drill pipe and tool joints. Disconnecting sections of the pipe in order to replace damaged or worn drilling devices or bits requires extra time and expense. Furthermore, only single-rotating direction devices can provide proper torque, resulting in limited available torque devices on the market and increased energy usage. Current drilling practices require large amounts of energy when tightening and torquing up the mechanical connection in order to effectuate the hydraulic fluid seal. Moreover, damaged mechanical seals cannot be replaced in the field.

SUMMARY

This present invention addresses the deficiencies associated with conventional geological drilling practices and provides both apparatus and method for rapid and efficient connecting and disconnecting of axially-referenced and sealed pipe joints. This improved method and apparatus allows the pipe to be rotated in either direction and to employ bi-rotational drill bits and other cutting devices (that will cut or crush formations when rotated in either direction), without backing off or unscrewing the pipe joints.

An important advantage of this invention is the increased efficiency of well drilling through the reduction of time, labor, and cost required of conventional equipment. By implementing a connecting and disconnecting method which allows a pipe to rotate in either a clockwise or counter clockwise direction, various devices such as drill bits may be manipulated (via surface rotation) for improved and continuous bi-rotational drilling, completion, and rapid repair and maintenance of wells without the possibility of becoming unscrewed or the need for repeatedly withdrawing and reinserting the drill pipe in and out of the well bore. In addition to rotating, the joints of the pipe will be axially-referenced and will provide a sealing method that is replaceable in the field.

Another important advantage of this invention is the increased protection of both personnel and land while drilling. Automated operations will not only reduce the amount of labor and eliminate the need for high torque required to connect and disconnect the mechanically sealed tool joints, but also will minimize the risk of injury to workers while connecting and disconnecting pipe joints. Regarding the land, conventional drilling practices such as surging, swabbing, tripping, or inserting and withdrawing the drill pipe at high speeds often inflict damage upon the well bore as well as the drilled geological formations; however, the employment of this invention will remedy these issues and provide the necessary protection.

DETAILED DESCRIPTION

In broad aspect the invention is a system for connecting drill pipe to facilitate bi-rotational drilling and methods of bi-rotational drilling using the described apparatus. The system includes a rotatable sleeve disposed on the end of one pipe joint and a guide on the other pipe joint in which both sleeve and guide have mating threads to pull the joint together and pipe end structures to prevent rotation when the joints are pulled together. Bi-rotational drilling as the term is used herein means the ability to rotate a pipe string for use in drilling or other operations in a well with rotating pipe in either direction- to the right or left. Drill pipe string refers to a plurality of connected pipe joints used in drilling and oil and gas well operations (hollow, thin-walled, steel or aluminum alloy piping) that is rotated during operation, and includes pipe for drilling into geologic formations, well completion, maintenance and repair. Conventionally, pipe joints (typically 27-32 feet in length and 2⅜ to 6⅝ inch outside diameter [OD]) in a drill string are threaded together and may only be rotated in a right hand direction (otherwise the joints become un-threaded. This invention provides an alternative connection means and method that allows rotation in both directions.

The detailed description in connection with the drawings is intended as a description of exemplary embodiments in which the presently disclosed apparatus and system can be practiced. The term "exemplary" used throughout this description means "serving as an example, instance, or illustration," and should not necessarily be construed as preferred or advantageous over other embodiments.

Figure 1:
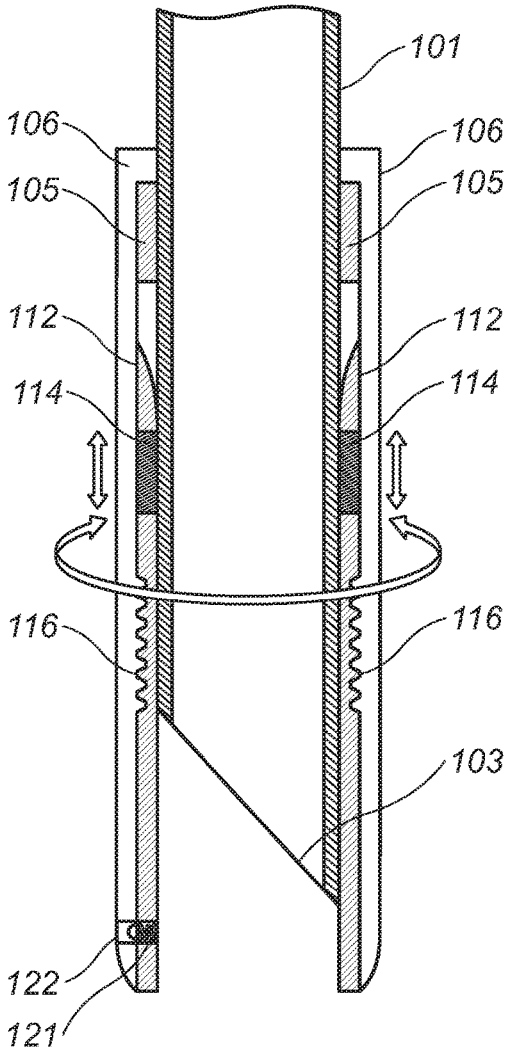
FIG. 1 is a plan view of a pipe joint bottom section of an embodiment of the invention.
Figure 2:
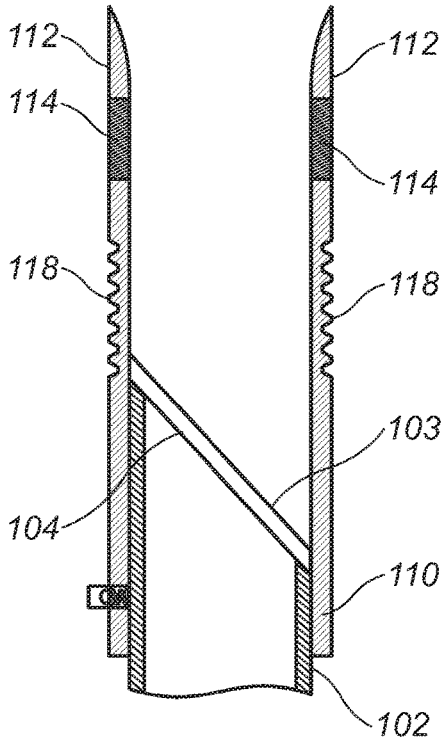
FIG. 2 is a plan view of a pipe joint top section of an embodiment of the invention.
Figure 3:
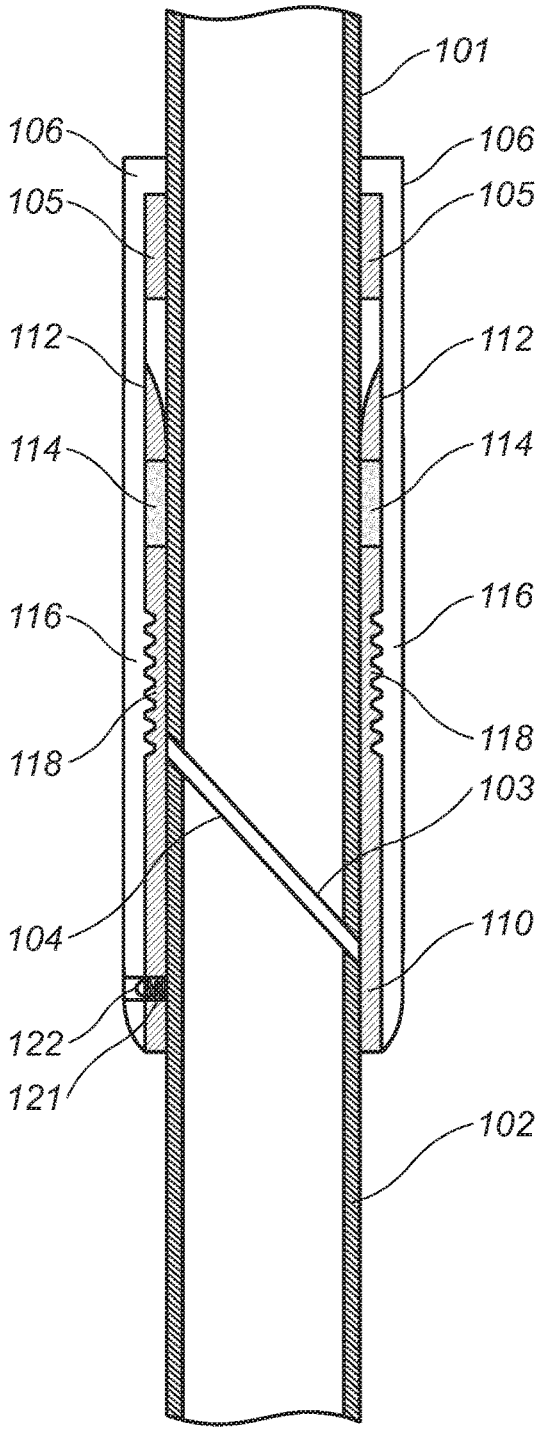
FIG. 3 is a plan view of pipe joints jointed together by a connector of an embodiment of the invention.
Figure 3A:
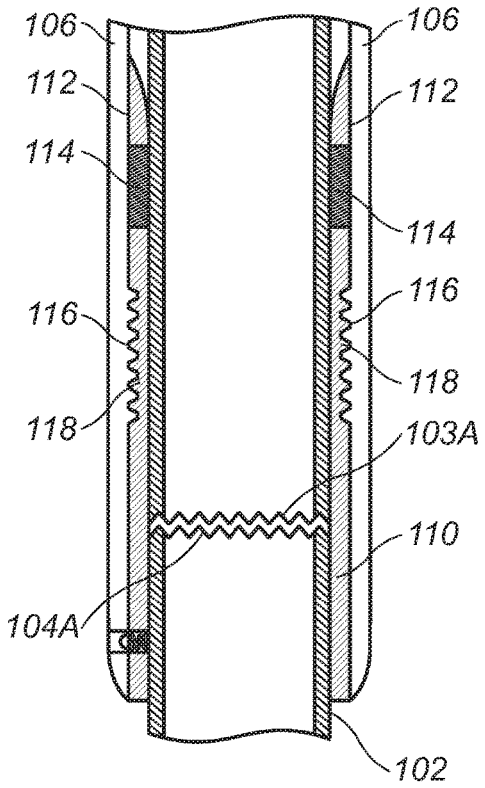
FIG. 3A is a section view of an alternative pipe section end cut of an embodiment of the invention.
Figure 3B:
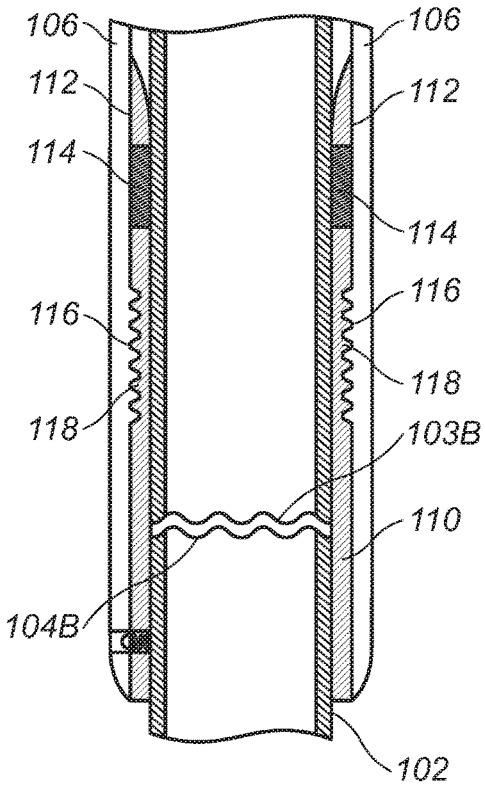
FIG. 3B is another section view of an alternative pipe section end cut of an embodiment of the invention.

Referring to the drawing, FIGS. 1 and 2 are exemplary bottom section and top sections of a drill pipe joint with the connection structures attached. Most joints in a string will have such a bottom section and a top section as illustrated in FIGS. 1, 2 and 3. FIG. 1 is a bottom section showing a drill pipe 101 to which is securely attached a sleeve collar stop 105 at a point near the end of the pipe. The sleeve collar stop may be welded, fused or pressure fitted to the pipe so long as it does not slip during use. Surrounding the pipe above the collar stop is a connection sleeve (collar). The sleeve (collar), 106, has an upper section that closely fits around the circumference of the pipe and an elongated section that has an internal diameter slightly larger than the outside diameter of the pipe 101. The inside diameter is sized to allow the elongated section of the sleeve to fit over a sealing element (114), threaded section (116) attached to the pipe 101 below the collar stop 105 and the guide section 110 of FIG. 2. There is a threaded section, 116, on the inside surface of the sleeve about midway from the collar stop and the end of the pipe 101. The sleeve is suitably made of hardened steel of the same type as the drill pipe but may be made of other metals that have the required strength. It may also be made of an engineered polymer having the strength of steel including polymer with glass, carbon or polymer fibers to provide added strength. A polymer sleeve is desirable as it reduces the risk of sparks that can cause explosions and fires. The end of the pipe is cut at an angle of about 15° to 65° (about 45° is preferred) (103). This angled end will mate with a corresponding angle in the top of the connected pipe (FIG. 2) to prevent turning when the pipes are seated. While angled ends are preferred other mating shapes such as a "saw tooth" pattern (103A and 204 in FIG. 3A) or curved (103B and 104B in FIG. 3B) are examples of shapes that are also suitable for the pipe ends. Any shape or configuration that will prevent independent pipe rotation when the pipe ends are mated is within the concept of the invention. There is an optional opening 122 in the lower section of the sleeve that is sized and shaped to allow an optional pin 121 (attached to the top of the connecting pipe) to be inserted. For perspective, in general the length of the sleeve will be about 3.5 to 6 times the pipe diameter, and preferably about 4 to 4.5 times the pipe diameter. Thus, for a 2⅜ inch OD drill pipe the sleeve will be about 10 to 12 inches in length.

An embodiment of a top section of drill pipes is illustrated in FIG. 2. The pipe 102 has guide section, 110, attached to the top of the pipe 102. The top is cut at an angle of about 15° to 65° (about 45° is preferred) to match and mate with the corresponding angle on the top pipe section 103. As in the top section this angled end will mate with a corresponding angle in the top of the connected pipe (FIG. 2) to prevent turning when the pipes are seated. While angled ends are preferred other mating shapes such as a "saw tooth" pattern (FIG. 3A) or curved (FIG. 3B) are examples of shapes that are also suitable for the pipe ends. Any shape or configuration that will prevent independent pipe rotation when the pipe end are mated is within the concept of the invention. This guide is sized and adapted to fit inside the sleeve 106 of the top pipe. The guide is jointed to pipe 102 at a point below the pipe end 104 and extends upward. The guide may be tapered at the top end 112 to assist in fitting the pipe joint together (to allow the sleeve of pipe 101 to slip over the guide. The guide has a threaded section, 116, on the outside circumference positioned and sized to be threaded with the threaded of the top pipe 101.

When joining the pipes 101 and 102 the top pipe is positioned above the bottom pipe joint and the sleeve 106, is lowered over the guide 110 of pipe joint 102 as illustrated in FIG. 3. The sleeve, 106, is prevented from falling off the pipe joint by the collar stop 105. When the threads 116 of pipe 101 engage the threads 116 of pipe joint 102, the sleeve is rotated drawing the threaded sections together. This action pulls the top and bottom 103 and 104 together and holds them securely in place. Thus, the joined pipe joints may be rotated in either direction (clockwise or counterclockwise) without becoming disengaged. The seals 114 prevent leakage and may be any suitable seals such as elastomeric O rings, chevron leaf seals and the like.

Figure 4:
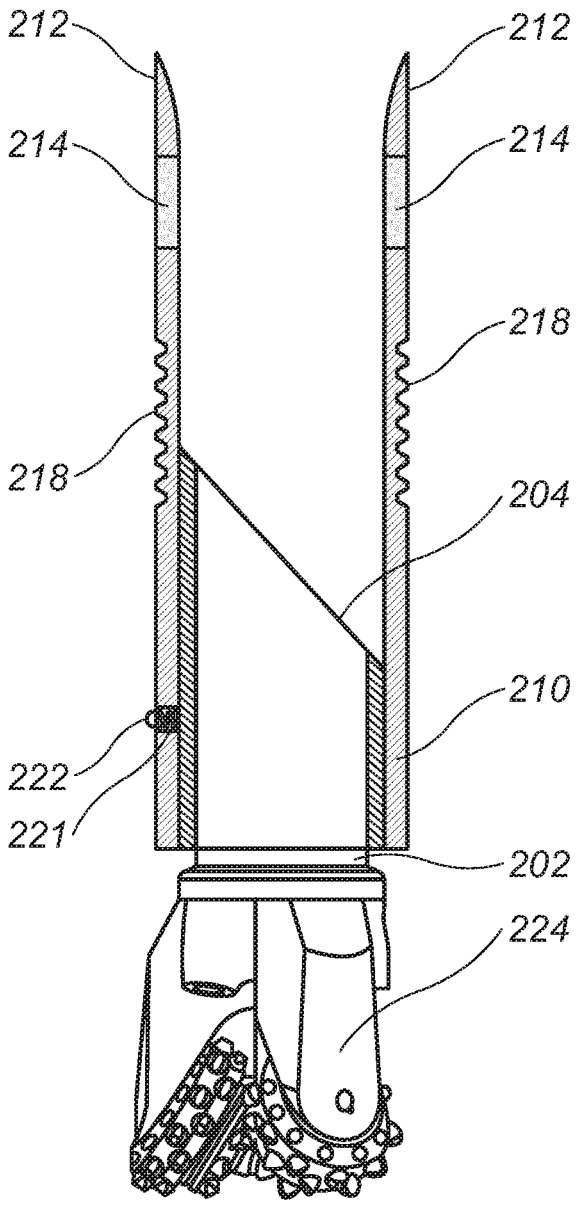
FIG. 4 is a plan view a drill bit joined to a half of a connector of an embodiment of the invention.

FIG. 4 illustrates a drill bit, 224, having a top attachment that is like that of the top section of pipe joint 102. This drill is exemplary of and of the conventional "bottom-hole assemblies". A bottom hole assembly (BHA) is the lowest part of the drill string, extending from the bit to the drill pipe or drill collar if so employed. The assembly can consist of drill collars, subs such as stabilizers, reamers, shocks, hole-openers, and the bit sub and bit.

As shown the assembly is coupled) to a pipe section, 202, identical to that of the top of pipe joint 102. The structure has a guide with tapered end, 212, sealant section, 214, and threads 218 located on the drill_pipe 210 and sloped top 204. Optionally there is a locking pin 221 and 222. The structure may be integral with the "bottom-hole assembly" but is preferred to be attached by a coupling as shown. Coupling may be threaded, fused, interference fitted or any other means that will make a secure connection and that may be rotated in either direction without disengaging.

An embodiment of the bi-rotational coupling system can be summarized as:

A drill pipe coupling system capable of rotation in clockwise and counterclockwise direction without decoupling comprising:

a first drill pipe with an end having an end structure comprising an elongated cylindrical sleeve open at one end and partially closed at the other end, the closed end having an opening sized to allow a section of drill pipe to pass through, the sleeve having an internal diameter sized to fit over the structure of a second pipe structure and having screw threads located at about mid-point on the inside diameter surface, and with ends having a projection surrounding and attached to the first drill pipe below the sleeve opening, and a second drill pipe with an end having a cylindrical guide structure surrounding and attached to the end of the second drill pipe having screw threads located at about mid-point on the outside diameter surface of the cylindrical structure and an recess for a seal at a point above the screw threads, and wherein the drill pipe end of the first and second drill pipes on which a structure is located are configured to resist rotation of the pipes when the ends are abutted together.

Operation

In operation a pipe joint will be fitted as shown with a top and bottom structure as in FIGS. 1, 2 and 3. The initial joint that will go into the well bottom will be fitted with a bottom-hole assembly such as a drill bit. The first drill pipe joint will be lifted into vertical position above a well bore hole and lowered into the hole, if one exist, but with the top section above ground (and drilling platform). A next joint will be positioned above the first joint and lowered to a point of contact. The rig assembly that lifts the joints into place will hold the first joint in place but have the capacity to rotate the pipe joint at least 180°. A second grip will hold the next joint into place and be capable of lifting and lowering and rotating the pipe joint. There will also need to be a rotating member that attaches around the sleeve of the lower section of each pipe joint to rotate the sleeve to engage the screw threads. When the joints are in position, one above the other, the top pipe joint will be rotated until the facet (pipe ends configurations such as angled cut) abut one another. Then the rotating member will be enclosed around the sleeve of the top pipe joint, optionally depress the locking pin, 121, and rotate the sleeve, (as 106) to engage the threads (as 116 and 118). As the threads are engaged the pipe joint ends are pulled together to a tight fit. The seal will provide a leak proof connection. When the pipe joints are separated as when they are pulled out of the hole, the optional locking pin will be depressed and the sleeve will be rotated in the reverse direction. When the sleeve is sufficiently raised or rotated the wall of the sleeve will keep the locking pin in a depressed, non-engaged, position. A drill system such as that described in published application 2015/0322736, published Nov. 12, 2015, can be adapted to provide the operation described above as can more conventional drilling systems. The disclosures of U.S. 2015/0322736 are incorporated herein by reference. A conventional drilling system is described in the Background of U.S. Pat. No. 7,806,191, issued Oct. 5, 2010, the disclosure of which is incorporated herein by reference.

Process of Bi-Rotational Drilling

In another aspect the invention is a process or method of drilling a borehole or working an existing drilled borehole. Drill pipe are fitted with a drill bit or other bottom-hole assembly and connected onto a drill string with bi-rotational connectors that allow the pipe string to be rotated in either a clockwise or counter wise direction. The drill bit is adapted to operate in either direction of rotation. During a drilling operation the drill string is rotated in one direction until there is an indication (by any means known in the art) that the drill bit is in need of repair or renewal—that is, that it is worn or damaged. Typically at that point the drill string would have to be pulled and the drill bit replaced or repaired. With the process of the invention, the drill string is not pulled but rotated in the opposite direction until there is an indication (by any means known in the art) that the drill bit operating in that direction is in need of repair or renewal—that is, that it is worn or damaged. Then the string is pulled. Potentially this can double the time that a drill string is in operation at enormous savings.

The process can be summarized as:

A method of drilling or servicing a bore hole in a geological formation comprising:

providing drill pipe joints having a bi-rotational rotation coupling system capable of rotation in clockwise and counterclockwise direction without decoupling, fitting a drill bit or other bottom-hole assembly to a drill collar if so employed or the first drill pipe joint, attaching additional joint(s) of drill pipe to the first drill pipe joint and to each other with a bi-rotational coupling connector means to form a bi-rotational drill string, rotating the bi-rotational drill string into a geological formation in one direction of rotation for a period of time then rotating the bi-rotational drill string into a geological formation in the opposite direction of rotation for a period of time.

A preferred connector for this bi-rotational drilling process is that describe above.

It will be readily apparent to those skilled in the art that many variations of the Invention may be employed without deviating from the scope of the claims. For example, any axially-referenced method along with a fluid-sealing means may be employed in the invention, including, the means for connecting and disconnecting, without limitation, with threaded sleeve, spring controlled sleeve, mechanical pistons, hydraulic pistons, snap rings, mechanical plungers, magnetically actuated plungers, magnetically actuated cams, flat springs or any combinations thereof. The connectors may be any other type known to those skilled in the art including, without limitation, means to connect and means to release that may be engaged or disengaged semi-permanently, automatically, manually, hydraulically, or magnetically. Many configurations of the invention within the scope of the claims, but not illustrated in the drawings, will be readily apparent to those skilled in the art having the benefit of this disclosure.

The invention claimed is:

1. A drill pipe coupling system capable of rotation in clockwise and counterclockwise direction without decoupling comprising:

a first drill pipe with an end having an end structure comprising an elongated cylindrical sleeve open at one end and partially closed at the other end, the closed end having an opening sized to allow a section of drill pipe to pass through and having screw threads located at about mid-point on the inside diameter surface and a second drill pipe with an end having a cylindrical guide structure surrounding and attached to the end of the second drill pipe, the sleeve having screw threads located at about mid-point located on the outside diameter surface of the cylindrical guide structure and a recess for a seal at a point above the screw threads, and wherein the first drill pipe sleeve has an internal diameter sized to fit over the cylindrical guide structure of the second pipe structure and wherein drill pipe distal end edges of the first and second drill pipes has end edges that are sloped, saw tooth shaped or curved end sections and configured so that the edges of the first and second pipes are mated when the ends are abutted together.

2. The drill pipe coupling system of claim 1 wherein the second drill pipe end guide structure comprises a sleeve structure having tapered ends at the end not attached to the second drill pipe.

3. The drill pipe coupling system of claim 1 wherein the first drill pipe elongated cylindrical sleeve has an opening in the cylinder wall located and sized to accommodate a pin located on the guide structure of the second drill pipe and wherein the second drill pipe guide structure has a pin and spring that is sized and located to project into the opening of the first drill pipe sleeve when the first and second pipe are joined together.

4. The drill pipe coupling system of claim 1 wherein the elongated cylinder sleeve of the first drill pipe in constructed of an engineered polymer.

5. The drill pipe coupling system of claim 1 wherein the second drill pipe is attached to a bottom hole assembly on the end away from the end having the guide structure.

6. A method of drilling or servicing a bore hole in a geological formation comprising:

providing drill pipe joints having a bi-rotational rotation coupling system capable of rotation in clockwise and counterclockwise direction without decoupling, fitting a drill bit or other bottom hole assembly to a drill collar or the first drill pipe joint, attaching additional joint(s) of drill pipe to the first drill pipe joint and to each other with a bi-rotational coupling connector means to form a bi-rotational drill string, rotating the bi-rotational drill string into a geological formation in one direction of rotation for a period of time then rotating the bi-rotational drill string into a geological formation in the opposite direction of rotation for a period of time, wherein the bi-rotational rotation coupling system comprises;

a first drill pipe with an end having an end structure comprising an elongated cylindrical sleeve open at one end and partially closed at the other end, the closed end having an opening sized to allow a section of drill pipe to pass through and having screw threads located at about mid-point on the inside diameter surface, and a second drill pipe with an end having a cylindrical guide structure surrounding and attached to the end of the second drill pipe, the sleeve having screw threads located at about mid-point located on the outside diameter surface of the cylindrical guide structure and a recess for a seal at a point above the screw threads, and wherein the first drill pipe sleeve has an internal diameter sized to fit over the cylindrical guide structure of the second pipe structure and wherein drill pipe distal end edges of the first and second drill pipes have end edges that are sloped, saw tooth shaped or curved end sections and configured so that the edges of the first and second pipes are mated when the ends are abutted together.

7. The method of claim 6 wherein the drill string is rotated in one direction until there is an indication by any means known in the art that the drill bit is in need of repair or renewal.

8. The method of claim 6 wherein there is a first end structure on one end of a drill pipe joint and a second end structure on the other end of the same drill pipe joint.

9. The method of claim 6 wherein the first drill pipe end structure cylindrical sleeve has an opening in the cylinder wall located and sized to accommodate a pin located on the guide structure of the second drill pipe and wherein the second drill pipe guide structure has a pin and spring that is sized and located to project into the opening of the first drill pipe sleeve when the first and second pipe are joined together.

10. The method of claim 6 wherein the sleeve structure of the first drill pipe in constructed of an engineered polymer.

* * * * *